United States Patent [19]

Polegato

[11] Patent Number: 5,044,096

[45] Date of Patent: Sep. 3, 1991

[54] SOLE STRUCTURE FOR FOOTWEAR

[75] Inventor: Mario Polegato, Crocetta Del Montello, Italy

[73] Assignee: Pol Scarpe Sportive S.r.l., Biadene, Italy

[21] Appl. No.: 448,393

[22] Filed: Dec. 11, 1989

[30] Foreign Application Priority Data

Feb. 17, 1989 [IT] Italy ..... 41525 A/89

[51] Int. Cl.[5] ..... A43B 7/06; A43B 13/00; A43B 13/12

[52] U.S. Cl. ..... 36/3 R; 36/3 B; 36/25 R; 36/30 R; 36/103

[58] Field of Search ..... 36/3 R, 3 B, 25 R, 30 R, 36/98, 103, 37

[56] References Cited

U.S. PATENT DOCUMENTS

| | | | |
|---|---|---|---|
| 878,039 | 2/1908 | Bullard | 36/37 |
| 3,205,595 | 9/1965 | Funck | 36/30 R |
| 4,292,746 | 10/1981 | Delaney | 36/83 |
| 4,463,505 | 8/1984 | Duclos | 36/30 R |
| 4,502,234 | 3/1985 | Schaefer et al. | 36/30 R |
| 4,551,930 | 11/1985 | Graham et al. | 36/30 R |
| 4,656,760 | 4/1987 | Tonkel et al. | 36/30 R |
| 4,899,465 | 2/1990 | Bleimhofer et al. | 36/12 |

FOREIGN PATENT DOCUMENTS

| | | | |
|---|---|---|---|
| 1228239 | 3/1960 | France | 36/3 R |

*Primary Examiner*—Paul T. Sewell
*Assistant Examiner*—M. D. Patterson
*Attorney, Agent, or Firm*—Guido Modiano; Albert Josif

[57] ABSTRACT

The sole structure comprises a lower part with a tread, preferably made of rubber or other synthetic material, and having holes formed therein which traverse its thickness. The lower part is covered by a membrane made of microporous, waterproof material which permits transpiration. The structure is completed by an upper part adapted for having a foot rested thereon and being made of rubber or other synthetic material. Holes which traverse the thickness of the upper part are provided at the portion thereof affected by the membrane.

5 Claims, 1 Drawing Sheet

SOLE STRUCTURE FOR FOOTWEAR

BACKGROUND OF THE INVENTION

The present invention relates to a sole structure for footwear.

The current widespread use of footwear with soles made of synthetic material or rubber is known.

Such footwear has undoubted advantages from the point of view of production and economy as well as from the point of view of being very practical in use.

The soles are in fact waterproof, wear-resistant, anti-slip, and can be produced in various shapes with desirable aesthetic effects, as well as being easy to use and economical.

However, such known types of soles have a considerable disadvantage, which resides in the fact that no outward transpiration of the sole of the foot is allowed, causing discomfort for the user or even giving rise to the condition known as "athelete's foot".

SUMMARY OF THE INVENTION

The aim of the present invention is to provide a sole structure made of synthetic material or rubber, which is produced in such a manner as to allow the transpiration of the foot despite being waterproof.

A consequent primary object of the invention is to provide a sole structure which has the same advantages as those currently commercially available, as well as being waterproof and allowing transpiration.

Another important object of the invention is to provide a sole structure which can be manufactured at low cost and which can therefore be sold at a competitive price.

A further object of the invention is to provide a sole structure which can be manufactured with known devices and methods.

A further object of the invention is to increase the user's comfort.

This aim, these objects and others which will become apparent hereinafter are achieved by a sole structure for footwear, characterized in that it comprises at least one lower part having a tread, a plurality of holes traversing the thickness of said at least one lower part and being covered by at least one membrane made of waterproof microporous material capable of permitting transpiration, and at least one upper part attached to said lower part and having through holes which traverse its thickness.

BRIEF DESCRIPTION OF THE DRAWINGS

Further characteristics and advantages of the invention will become apparent from the detailed description of a preferred embodiment thereof, illustrated only by way of non-limitative example in the accompanyingg drawings, wherein.

DESCRIPTION OF THE PREFERRED EMBODIMENTS

Figure 1:
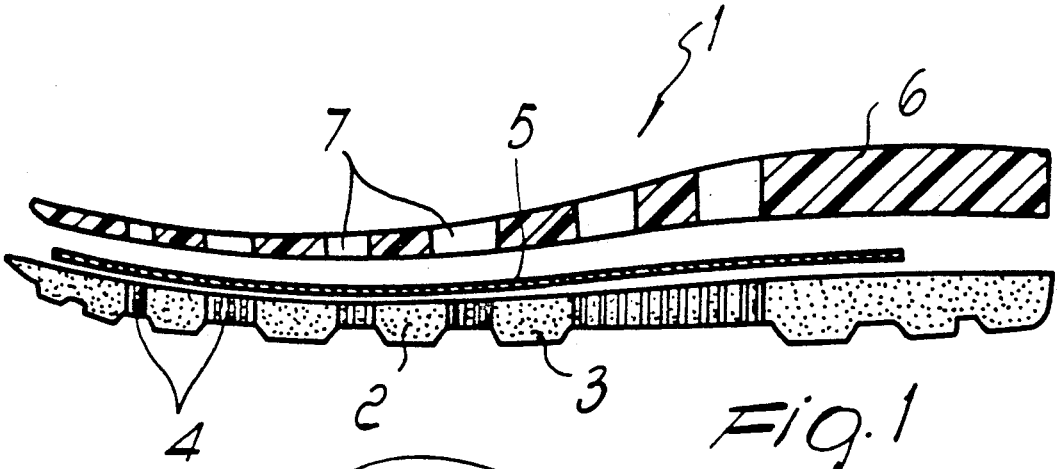
FIG. 1 is a longtitudinal sectional view of a preferred embodiment of the parts which compose the sole structure according to the invention.
Figure 2:
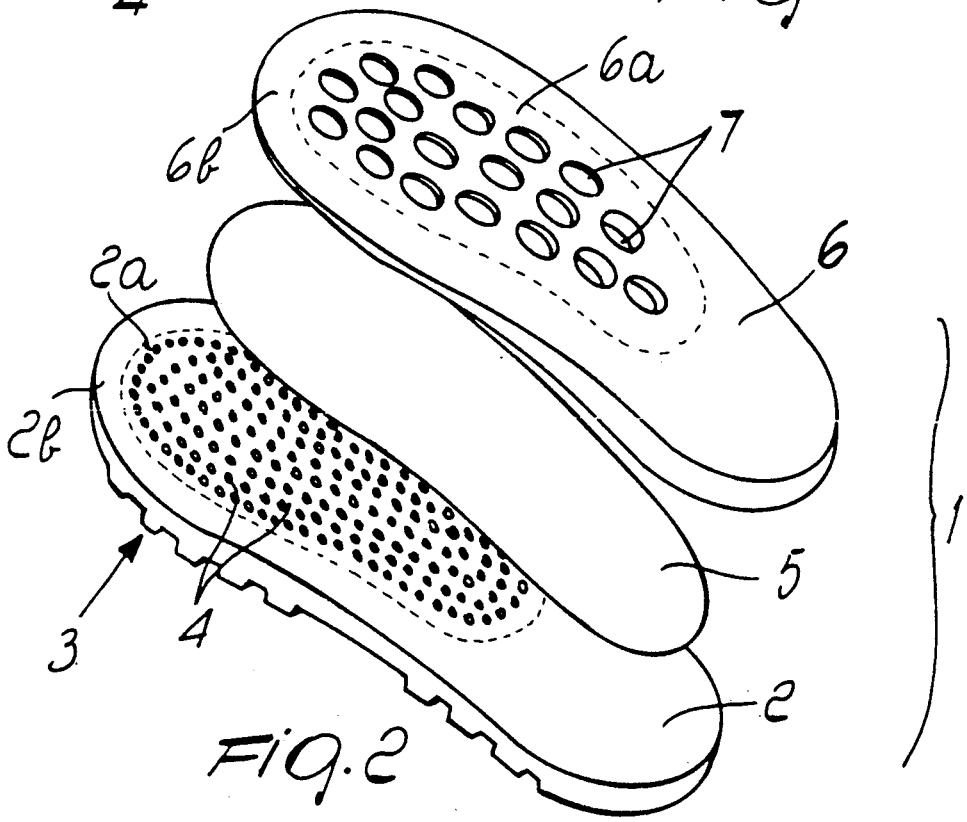
FIG. 2 is an exploded view of a sole structure according to the invention.
Figure 3:
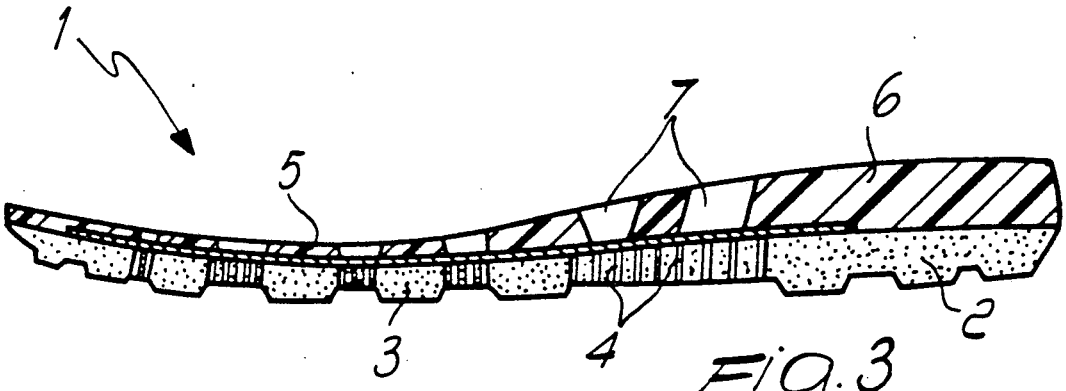
FIG. 3 is a longitudinal sectional view of the sole structure according to the invention when assembled.

With reference to the above described figures, a sole structure for footwear according to the invention, which permits transpiration while being waterproof, comprises an outside sole or outsole structure generally indicated by the reference numeral 1 which essentially comprises a lower part 2, with a tread 3, made of synthetic material or rubber or similar material and provided with a series of fine holes or micro-pores 4 which transverse its thickness and are conveniently arranged in its inner regions or areas 2*a*.

A waterproof microporous membrane 5, which permits transpiration, is arranged above said part 2. The membrane 5 is preferably made of material such as the material known by the Trade Mark "Gore-Tex" or another equivalent material.

The structure is completed by an upper part 6 on which the foot rests. The upper part is attached to the lower part 2 and has a series of holes 7 which traverse its thickness and which are arranged in the zone 6*a*.

Said upper part 6 is also made of synthetic material or rubber or similar material and is assembled and coupled to the lower part 2 in the regions 2*b* and 6*b* which are defined perimetrically respectively to the area 2*a* and zone 6*a* and which are not affected by said microporous membrane 5 such perimetric regions 2*b* and 6*b* thus act as coupling regions between the lower part 2 and the upper part 6.

The structure according to the invention can be manufactured by means of current methods without any difficulty. The assembly of the lower part 2 and the upper part 6 must be effected to finally form a monolithic structure so as to prevent the infiltration of water through the joint define between the two parts.

The fact should furthermore be stressed that during assembly, no adhesive or other material must affect the regions provided with holes 4, with the holes 7 and the regions occupied by the membrane 5.

Examples of methods usuable to produce the structure of sole according to the invention can be injection-molding or press-glueing.

In the case of injection moulding, once the lower part is injected into the mold, the membrane 5 can be positioned and the upper part 6 can then be injected.

The resultant structure is monolithic and the microporous membrane 5 is embedded therein.

In the case of press-glueing, the lower part 2 and the upper part 6 are molded beforehand and are subsequently coupled by means of adhesives after interposing said membrane 5.

The final result is a structure which, by virture of the presence of the membrane, is waterproof in one direction while allowing the foot to transpire, through the various perforations and the membrane, in opposite direction.

In practice it has thus been observed that the invention has brilliantly achieved the intended aim and objects, a sole structure having been provided which can be produced with current methods and devices and is suitable for achieving a greater comfort of the foot by permitting transpiration while remaining waterproof, thereby completely eliminating the main disadvantage of known sole structures.

The invention thus conceived is susceptible to numerous modifications and variations, all of which are within the scope of the inventive concept; all the details may furthermore be replaced with technically equivalent elements.

In practice, any materials, shapes and dimensions may be employed, providing that they are compatible with contingent requirements and the intended use.

I claim:

1. Sole structure for footwear, comprising an outsole which comprises at least one lower part and at least one upper part which are mutually united to form said outsole, said lower part defining an area at which a plurality of holes is provided which transverse said lower part, said upper part defining a zone at which through holes are provided which traverse said upper part, said outsole further comprising at least on microporous waterproof membrane means sandwiched between said mutually united upper and lower parts, wherein said lower part defines a lower part perimetric region encompassing said area and said upper part defines an upper part perimetric region encompassing said zone, said lower part perimetric region being a lower part coupling region and said upper part perimetric region being an upper part coupling region, said lower part and said upper part being mutually united at said upper part coupling region and said lower part coupling region in a manner to create a fluid-tight seal at said coupling regions, said membrane means being arranged between said upper part and said lower part inside said coupling regions thereof.

2. Sole structure according to claim 1, wherein said membrane means of said outsole is comprised of waterproof material which permits transpiration.

3. Sole structure according to claim 1, wherein said lower part and said upper part of said outsole are united by press-glueing in which a separately molded said lower part and a separately molded said upper part are united at said coupling regions by means of adhesives.

4. Sole structure according to claim 1, wherein said outsole is obtained by injection molding in which said lower part and said upper part are mutually monolithic, said membrane means being embedded therein.

5. Sole structure for footwear, comprising an outsole which comprises at least one lower part and at least one upper part which are mutually monolithic, said lower part defining an area at which a plurality of holes is provided which traverse said lower part, said upper part defining a zone at which through holes are provided which traverse said upper part, said lower part defining a lower part perimetric region encompassing said area and said upper part defining an upper part perimetric region encompassing said zone, said lower part perimetric region being a lower part coupling region and said upper part perimetric region being an upper part coupling region, said lower part and said upper part being mutually monolithic at said upper part coupling region and said lower part coupling region thereby creating a fluid-tight seal at said coupling regions, said outsole further comprising at least one microporous waterproof membrane means sandwiched between said mutuallly monolithic upper and lower parts, at least a portion of said microporous waterproof membrane means being arranged between said area of said upper part and said zone of said lower part.

* * * * *

US005044096B1

REEXAMINATION CERTIFICATE (3694th)

United States Patent [19] [11] B1 5,044,096

Polegato [45] Certificate Issued Dec. 29, 1998

[54] SOLE STRUCTURE FOR FOOTWEAR

[75] Inventor: Mario Polegato, Crocetta Del Montello, Italy

[73] Assignee: Pol Scarpe Sportive S.r.l., Biade, Italy

Reexamination Request:
No. 90/004,111, Jan. 16, 1996

Reexamination Certificate for:

| | |
|---|---|
| Patent No.: | **5,044,096** |
| Issued: | **Sep. 3, 1991** |
| Appl. No.: | **448,393** |
| Filed: | **Dec. 11, 1989** |

[30] Foreign Application Priority Data

Feb. 17, 1989 [IT] Italy ..... 41525 A/89

[51] Int. Cl.[6] ..... A43B 7/06; A43B 13/00; A43B 13/12

[52] U.S. Cl. ..... 36/3 R; 36/3 B; 36/25 R; 36/30 R; 36/103

[58] Field of Search ..... 36/3 R, 3 B, 25 R, 36/30 R, 98, 103, 37

[56] References Cited

U.S. PATENT DOCUMENTS

| | | | |
|---|---|---|---|
| 1,685,538 | 9/1928 | Glidden et al. . | |
| 4,463,505 | 8/1984 | Duclos | 36/25 R |
| 4,507,880 | 4/1985 | Ohashi | 36/3 B |

FOREIGN PATENT DOCUMENTS 1407372 5/1973 United Kingdom .

*Primary Examiner*—Marie Denise Patterson

[57] ABSTRACT

The sole structure comprises a lower part with a tread, preferably made of rubber or other synthetic material, and having holes formed therein which traverse its thickness. The lower part is covered by a membrane made of microporous, waterproof material which permits transpiration. The structure is completed by an upper part adapted for having a foot rested thereon and being made of rubber or other synthetic material. Holes which traverse the thickness of the upper part are provided at the portion thereof affected by the membrane.

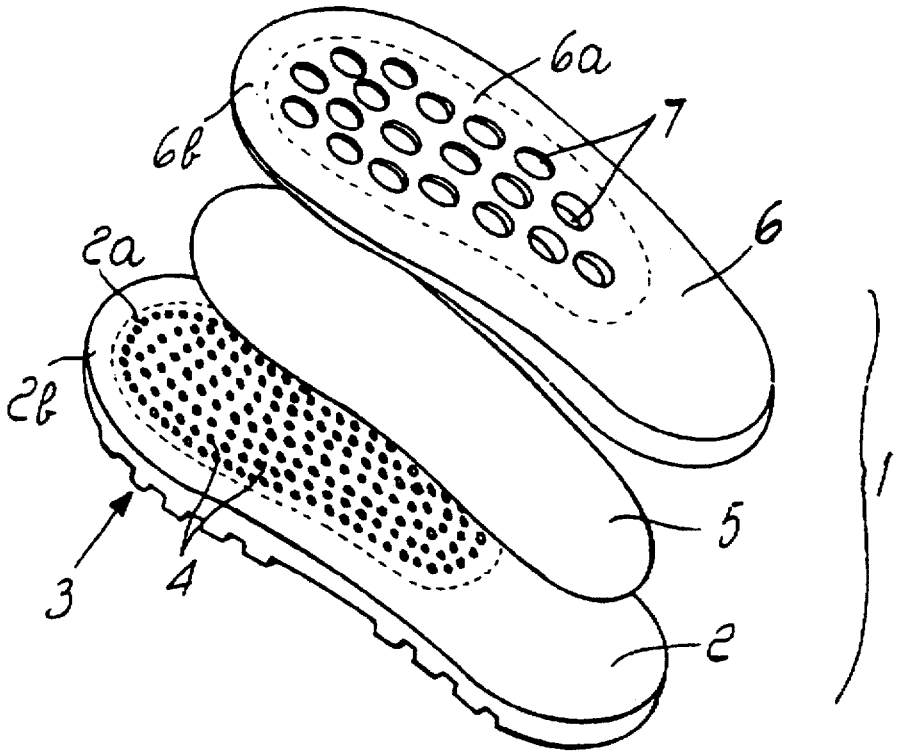

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 5 are determined to be patentable as amended.

Claims 2-4, dependent on an amended claim, are determined to be patentable.

New claims 6 and 7 are added and determined to be patentable.

1. Sole structure for footwear, comprising an outsole which comprises at least one lower part and at least one upper part which are mutually united to form said outsole, said lower part defining an area at which a plurality of holes is provided which transverse said lower part, said upper part defining a zone at which through holes are provided which traverse said upper part, said outsole further comprising at least [on] *one* microporous waterproof membrane means sandwiched between said mutually united upper and lower parts, wherein said lower part defines a lower part perimetric region encompassing said area and said upper part defines an upper part perimetric region encompassing said zone, said lower part permietric region being a lower part coupling region and said upper part perimetric region being an upper part coupling region, said lower part and said upper part being mutually united at said upper part coupling region and said lower part coupling region in a manner to create a fluid-tight seal at said coupling regions, said membrane means being arranged between said upper part and said lower part inside said coupling regions thereof.

5. Sole structure for footwear, comprising an outsole which comprises at least one lower part and at least one upper part which are mutually monolithic, said lower part defining an area at which a plurality of holes is provided which traverse said lower part, said upper part defining a zone at which through holes are provided which traverse said upper part, said lower part defining a lower part perimetric region encompassing said area and said upper part defining an upper part perimetric region encompassing said zone, said lower part perimetric region being a lower part coupling region and said upper part perimetric region being an upper part coupling region, said lower part and said upper part being mutually monolithic at said upper part coupling region and said lower part coupling region thereby creating a fluid-tight seal at said coupling regions, said outsole further comprising at least one microporous waterproof membrane means sandwiched between said [mutuallly] *mutually* monolithic upper and lower parts, at least a portion of said microporous waterproof membrane means being arranged between said [area] *zone* of said upper part and said [zone] *area* of said lower part.

6. Sole structure according to claim 1 therein said upper part of said lower part of said outsole are made of rubber.

7. Sole structure according to claim 5 wherein said upper part and said lower part of said outsole are made of rubber.

* * * * *